US006391531B1

(12) United States Patent
Dickerson

(10) Patent No.: US 6,391,531 B1
(45) Date of Patent: May 21, 2002

(54) LOW SILVER RADIOGRAPHIC FILM AND IMAGING ASSEMBLY FOR THORACIC IMAGING

(75) Inventor: Robert E. Dickerson, Hamlin, NY (US)

(73) Assignee: Eastman Kodak Company, Rochester, NY (US)

( * ) Notice: Subject to any disclaimer, the term of this patent is extended or adjusted under 35 U.S.C. 154(b) by 12 days.

(21) Appl. No.: 09/707,069

(22) Filed: Nov. 6, 2000

(51) Int. Cl.[7] ..... G03C 1/005
(52) U.S. Cl. ..... 430/502; 430/139
(58) Field of Search ..... 430/502, 139

(56) References Cited

U.S. PATENT DOCUMENTS 4,803,150 A 2/1989 Dickerson et al.
4,900,652 A 2/1990 Dickerson et al.
4,994,355 A 2/1991 Dickerson et al.
4,997,750 A 3/1991 Dickerson et al.
5,021,327 A 6/1991 Bunch et al.
5,108,881 A 4/1992 Dickerson et al.
5,344,749 A 9/1994 Kiekens et al.
5,541,028 A 7/1996 Lee et al.
5,576,156 A 11/1996 Dickerson
5,824,459 A * 10/1998 Dickerson ..... 430/502
5,853,967 A * 12/1998 Dickerson ..... 430/502
5,952,162 A 9/1999 Dickerson et al.

* cited by examiner

*Primary Examiner*—Hoa Van Le
(74) *Attorney, Agent, or Firm*—J. Lanny Tucker

(57) ABSTRACT

High performance radiographic films exhibit excellent exposure latitude when imaged in radiographic imaging assemblies comprising intensifying screens. These films having at least two tabular silver halide emulsions on each side of a film support, and the emulsion closest to the film support on each side includes chemistry to control crossover and a rhodium dopant and has higher photographic speeds than the other emulsions. These films are particularly useful for thoracic imaging.

22 Claims, No Drawings

LOW SILVER RADIOGRAPHIC FILM AND IMAGING ASSEMBLY FOR THORACIC IMAGING

FIELD OF THE INVENTION

This invention is directed to a low silver radiographic film that can be rapidly processed and directly viewed. This film is particularly useful for thoracic imaging. In addition, the radiographic film of this invention also has excellent exposure latitude. This invention also provides a film/screen imaging assembly for radiographic purposes, and a method of processing the film to obtain a black-and-white image.

BACKGROUND OF THE INVENTION

Over one hundred years ago, W. C. Roentgen discovered X-radiation by the inadvertent exposure of a silver halide photographic element. In 1913, Eastman Kodak Company introduced its first product specifically intended to be exposed by X-radiation (X-rays). Today, radiographic silver halide films account for the overwhelming majority of medical diagnostic images. Such films provide viewable black-and-white images upon imagewise exposure followed by processing with the suitable wet developing and fixing photochemicals.

In medical radiography an image of a patient's anatomy is produced by exposing the patient to X-rays and recording the pattern of penetrating X-radiation using a radiographic film containing at least one radiation-sensitive silver halide emulsion layer coated on a transparent support. X-radiation can be directly recorded by the emulsion layer where only low levels of exposure are required. Because of the potential harm of exposure to the patient, an efficient approach to reducing patient exposure is to employ one or more phosphor-containing intensifying screens in combination with the radiographic film (usually both in the front and back of the film). An intensifying screen absorbs X-rays and emits longer wavelength electromagnetic radiation that the silver halide emulsions more readily absorb.

Another technique for reducing patient exposure is to coat two silver halide emulsion layers on opposite sides of the film support to form a "dual coated" radiographic film so the film can provide suitable images with less exposure. Of course, a number of commercial products provide assemblies of both dual coated films in combination with two intensifying screens to allow the lowest possible patient exposure to X-rays. Typical arrangements of film and screens are described in considerable detail for example in U.S. Pat. No. 4,803,150 (Dickerson et al), U.S. Pat. No. 5,021,327 (Bunch et al) and U.S. Pat. No. 5,576,156 (Dickerson).

Medical radiographic X-radiation films are currently manufactured with several different contrasts in order to meet the diverse radiographic imaging needs. These include high contrast films such as commercially available KODAK TMAT-G Film and low contrast films such as KODAK TMAT-L Film. High contrast films are designed to image anatomy parts that exhibit a narrow range of X-radiation absorbance (such as bones). Medium and low contrast films are designed to image simultaneously several different types of anatomy having differing X-radiation absorbance. Radiography of the thoracic cavity (chest) is an example of this need there radiologists need to image the relatively radioopaque mediastinal area (behind the vertebral column, heart and diaphragm). These areas are quite dense and require greater amounts of X-radiation for desired penetration and imaging on a film. However, it is also desired to image the more radiotransparent lungs. Such imaging requires less X-radiation. KODAK InSight™ IT Film and KODAK InSight™ VHC Film, and the appropriate intensifying screens, are low crossover systems designed to record this wide range of tissue densities with high imaging quality and varying exposure latitude.

Control of intensifying screen light crossover has been very important for providing high-resolution medical X-radiation films. "Crossover" refers to exposure of an emulsion from light emitted by an intensifying screen on the opposite of the film and results in reduced image sharpness. Approaches to achieve crossover control include the use of high aspect ratio tabular silver halide emulsions containing spectral sensitizing dyes. This approach can reduce crossover from 30% to 18%. Further reduction in crossover below 10% has been achieved using microcrystalline dyes in the silver halide emulsion or antihalation layer. These microcrystalline dyes are readily decolorized during the wet processing cycle so they are not visible in the resulting image.

During recent years as radiographic films were designed to have high resolution, similar improvements were being achieved in the reduction of processing time. Only a few years ago, processing cycles ("dry to dry") of 90 seconds were the standard in the industry. More recent processing systems such as Eastman Kodak's Rapid Access (RA) system that include forehardened films, special processing chemistry and rapid processing equipment, has reduced the processing cycle to 40 seconds. Because of this trend to faster processing, greater demands are placed on the drying of radiographic films since the other processing steps (development, fixing, and washing) are being shortened.

The greatest problem has been to quickly process low crossover radiographic films that include particulate filter dyes in a separate layer because that feature adds additional film thickness that must be dried.

With these constraints in mind, the industry has been looking for a thoracic radiographic film that would provide good lung field information while also providing information in more radiopaque areas such as the mediastinum and retrocardiac regions. It is also desirable to have a radiographic film/screen combination that has the desired image quality, rapid processability, and high resolution.

SUMMARY OF THE INVENTION

The present invention provides a solution to the noted problems with a radiographic silver halide film comprising a support having first and second major surfaces and that is capable of transmitting X-radiation, the film having disposed on the first major support surface, two or more hydrophilic colloid layers including first and second silver halide emulsion layers, and on the second major support surface, two or more hydrophilic colloid layers including third and fourth silver halide emulsion layers, the first and third silver halide emulsion layers being closer to the support than the second and fourth silver halide emulsion layers, each of the first, second, third and fourth silver halide emulsion layers comprising silver halide tabular grains that (a) have the same or different composition in each silver halide emulsion layer, (b) account for at least 50% of the total grain projected area within each silver halide emulsion layer, (c) have an average thickness of less than 0.3 $\mu$m, and (d) have an average aspect ratio of greater than 5, the silver coverage on each side of the support being from about 15 to about 20 mg/dm$^2$, all hydrophilic layers of the film being fully forehardened and wet processing solution permeable for image formation within 45 seconds, the first and third silver halide emulsion layers comprising at least one particulate dye that is (a) capable of absorbing radiation to which the silver halide emulsions are sensitive, (b) present in an amount sufficient to reduce crossover to less than 15%, and (c) capable of being substantially decolorized during wet processing, the first and third silver halide emulsion layers also comprising a rhodium dopant for the tabular silver halide grains, the rhodium dopant being present in each silver halide emulsion layer in an amount, independently, of from about $1\times10^{-5}$ to about $5\times10^{-5}$ mole per mole of silver in each emulsion layer, the ratio of photographic speed of the first silver halide emulsion layer to the second silver halide emulsion layer and the ratio of the third silver halide emulsion layer to the fourth silver halide emulsion layer being independently greater than 0.3 log E.

This invention also provides a radiographic imaging assembly comprising the radiographic film described above provided in combination with an intensifying screen on either side of the film.

Further, this invention is method comprising contacting the radiographic film described above, sequentially, with a black-and-white developing composition and a fixing composition, the method being carried out within 90 seconds to provide a black-and-white image.

Thus, the present invention provides a radiographic film and film/intensifying screen assembly that gives the medical professional a greater ability to image the thoracic cavity with excellent exposure latitude. Thus, this film can be confidently used for thoracic imaging in the lung field while also providing information in more radioopaque areas such as the mediastinum and retrocardiac regions.

In addition, all other desirable sensitometric properties are maintained, crossover is desirably low, the images have high resolution, and the films can be rapidly processed in conventional processing equipment and compositions.

Such advantages can be achieved with relatively lower silver coverage in the emulsion layers on both sides of the support and the presence of a rhodium dopant in the emulsion layers closer to the support.

DETAILED DESCRIPTION OF THE INVENTION

The term "contrast" as herein employed indicates the average contrast (also referred to as $\gamma$) derived from a characteristic curve of a radiographic element using as a first reference point (1) a density ($D_1$) of 0.25 above minimum density and as a second reference point (2) a density ($D_2$) of 2.0 above minimum density, where contrast is $\Delta D$ (i.e. 1.75)$\div\Delta\ \log_{10}E(\log_{10}E_2-\log_{10}E_1)$, $E_1$ and $E_2$ being the exposure levels at the reference points (1) and (2).

"Gamma" is described as the instantaneous rate of change of a D log E sensitometric curve or the contrast at any log E value.

"Peak gamma" is the point of the sensitometric curve where the maximum gamma is achieved.

"Mid-scale contrast" is the slope of the characteristic curve measured between a density of 0.25 above $D_{min}$ to 2.0 above $D_{min}$ Photographic "speed" refers to the exposure necessary to obtain a density of at least 1.0 plus $D_{min}$.

"Dynamic range" refers to the range of exposures over which useful images can be obtained.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "tabular grain" is used to define a silver halide grain having two parallel crystal faces that are clearly larger than any remaining crystal faces and having an aspect ratio of at least 2. The term "tabular grain emulsion" refers to a silver halide emulsion in which the tabular grains account for more than 50% of the total grain projected area.

The term "covering power" is used to indicate 100 times the ratio of maximum density to developed silver measured in $mg/dm^2$.

The term "rare earth" is used to refer to elements having an atomic number of 39 or 57 to 71.

The term "front" and "back" refer to locations nearer to and further from, respectively, the source of X-radiation than the support of the film.

The term "dual-coated" is used to define a radiographic film having silver halide emulsion layers disposed on both the front- and backsides of the support.

Since two or more silver halide emulsions are disposed on each side of the film support, the "bottom" silver halide emulsion layer is closest to the film support and is defined herein as the "first" or "third" emulsion depending upon which side of the support it resides. The "top" silver halide emulsion layer is farther from the film support and is defined herein as the second or fourth emulsion depending upon which side of the support it resides. Thus, the "first" and "second" silver halide emulsion layers are on one side of the support and the "third" and "fourth" silver halide emulsion layers are on the opposite side of the support.

The radiographic films of this invention include a flexible support having disposed on both sides thereof: two or more silver halide emulsion layers and optionally one or more non-radiation sensitive hydrophilic layer(s). The silver halide emulsions in the various layers can be the same or different, and can comprise mixtures of various silver halide emulsions in or more of the layers.

In preferred embodiments, the film has the same silver halide emulsions on both sides of the support. For example, the "bottom" emulsions on both sides can be the same and the "top" emulsion layers can also have the same silver halide emulsions. It is also preferred that the films have a protective overcoat (described below) over the silver halide emulsions on each side of the support.

The support can take the form of any conventional radiographic element support that is X-radiation and light transmissive. Useful supports for the films of this invention can be chosen from among those described in *Research Disclosure,* September 1996, Item 38957 XV. Supports and *Research Disclosure,* Vol. 184, August 1979, Item 18431, XII. Film Supports. *Research Disclosure* is published by Kenneth Mason Publications, Ltd., Dudley House, 12 North Street, Emsworth, Hampshire P010 7DQ England.

The support is a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure,* Item 38957, Section XV Supports, cited above, attention is directed particularly to paragraph (2) that describes subbing layers, and paragraph (7) that describes preferred polyester film supports.

In the more preferred embodiments, at least one non-light sensitive hydrophilic layer is included with the two or silver halide emulsion layers on each side of the film support. This layer may be called an interlayer or overcoat, or both.

The silver halide emulsion layers comprise one or more types of silver halide grains responsive to X-radiation. Silver halide grain compositions particularly contemplated include those having at least 80 mol % bromide (preferably at least 98 mol % bromide) based on total silver in a given emulsion layer. Such emulsions include silver halide grains composed of, for example, silver bromide, silver iodobromide, silver chlorobromide, silver iodochlorobromide, and silver chloroiodobromide. Iodide is generally limited to no more than 3 mol % (based on total silver in the emulsion layer) to facilitate more rapid processing. Preferably iodide is limited to no more than 2 mol % (based on total silver in the emulsion layer) or eliminated entirely from the grains. The silver halide grains in each silver halide emulsion unit (or silver halide emulsion layers) can be the same or different, or mixtures of different types of grains.

The silver halide grains useful in this invention can have any desirable morphology including, but not limited to, cubic, octahedral, tetradecahedral, rounded, spherical or other non-tabular morphologies, or be comprised of a mixture of two or more of such morphologies. Preferably, the grains are tabular grains and the emulsions are tabular grain emulsions in each silver halide emulsion layer.

In addition, different silver halide emulsion layers can have silver halide grains of the same or different morphologies as long as at least 50% of the grains are tabular grains. For cubic grains, the grains generally have an ECD of at least 0.8 $\mu$m and less than 3 $\mu$m (preferably from about 0.9 to about 1.4 $\mu$m). The useful ECD values for other non-tabular morphologies would be readily apparent to a skilled artisan in view of the useful ECD values provided for cubic and tabular grains.

Generally, the average ECD of tabular grains used in the films is greater than 0.9 $\mu$m and less than 4.0 $\mu$m, and preferably greater than 1 and less than 3 $\mu$m. Most preferred ECD values are from about 1.6 to about 2.4 $\mu$m. The average thickness of the tabular grains is generally at least 0.1 and no more than 0.3 $\mu$m, and preferably at least 0.12 and no more than 0.18 $\mu$m.

It may also be desirable to employ silver halide grains that exhibit a coefficient of variation (COV) of grain ECD of less than 20% and, preferably, less than 10%. In some embodiments, it may be desirable to employ a grain population that is as highly monodisperse as can be conveniently realized.

Generally, at least 50% (and preferably at least 80%) of the silver halide grain projected area in each silver halide emulsion layer is provided by tabular grains having an average aspect ratio greater than 5, and more preferably greater than 10. The remainder of the silver halide projected area is provided by silver halide grains having one or more non-tabular morphologies.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al), U.S. Pat. No. 4,425,426 (Abbott et al), U.S. Pat. No. 4,439,520 (Kofron et al), U.S. Pat. No. 4,434,226 (Wilgus et al), U.S. Pat. No. 4,435,501 (Maskasky), U.S. Pat. No. 4,713,320 (Maskasky), U.S. Pat. No. 4,803,150 (Dickerson et al), U.S. Pat. No. 4,900,355 (Dickerson et al), U.S. Pat. No. 4,994,355 (Dickerson et al), U.S. Pat. No. 4,997,750 (Dickerson et al), U.S. Pat. No. 5,021,327 (Bunch et al), U.S. Pat. No. 5,147,771 (Tsaur et al), U.S. Pat. No. 5,147,772 (Tsaur et al), U.S. Pat. No. 5,147,773 (Tsaur et al), U.S. Pat. No. 5,171,659 (Tsaur et al), U.S. Pat. No. 5,252,442 (Dickerson et al), U.S. Pat. No. 5,370,977 (Zietlow), U.S. Pat. No. 5,391,469 (Dickerson), U.S. Pat. No. 5,399,470 (Dickerson et al), U.S. Pat. No. 5,411,853 (Maskasky), U.S. Pat. No. 5,418,125 (Maskasky), U.S. Pat. No. 5,494,789 (Daubendiek et al), U.S. Pat. No. 5,503,970 (Ohn et al), U.S. Pat. No. 5,536,632 (Wen et al), U.S. Pat. No. 5,518,872 (King et al), U.S. Pat. No. 5,567,580 (Fenton et al), U.S. Pat. No. 5,573,902 (Daubendiek et al), U.S. Pat. No. 5,576,156 (Dickerson), U.S. Pat. No. 5,576,168 (Daubendiek et al), U.S. Pat. No. 5,576,171 (Ohn et al), and U.S. Pat. No. 5,582,965 (Deaton et al). The patents to Abbott et al, Fenton et al, Dickerson and Dickerson et al are also cited and incorporated herein to show conventional radiographic film features in addition to gelatino-vehicle, high bromide (>80 mol % bromide based on total silver) tabular grain emulsions and other features useful in the present invention.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure,* Item 38957, cited above, Section I. Emulsion grains and their preparation, sub-section D. Grain modifying conditions and adjustments, paragraphs (3), (4), and (5).

It is essential however that at least the bottom silver halide emulsion layers (that is the first and third emulsion layers) contain one or more rhodium dopants for the tabular silver halide grains. These dopants must be present in an amount of from about $1\times10^{-5}$ to about $5\times10^{-5}$ mole per mole of silver in each emulsion layer, and preferably at from about $2\times10^{-5}$ to about $4\times10^{-5}$ mol/mol Ag in each emulsion layer. The amount of rhodium dopant can be the same or different in these layers. Preferably, the amount of rhodium dopant is the same in each of the first and third emulsion layers.

Useful rhodium dopants are well known in the art and are described for example in U.S. Pat. No. 3,737,313 (Rosecrants et al), U.S. Pat. No. 4,681,836 (Inoue et al) and U.S. Pat. No. 2,448,060 (Smith et al). Representative rhodium dopants include, but are not limited to, rhodium halides (such as rhodium monochloride, rhodium trichloride, diammonium aquapentachlororhodate, and rhodium ammonium chloride), rhodium cyanates {such as salts of $[Rh(CN)_6]^{-3}$, $[RhF(CN)_5]^{-3}$, $[RhI_2(CN)_4]^{-3}$ and $[Rh(CN)_5(SeCN)]^{-3}$}, rhodium thiocyanates, rhodium selenocyanates, rhodium tellurocyanates, rhodium azides, and others known in the art, for example as described in *Research Disclosure,* Item 437013, page 1526, September 2000 and publications listed therein, all incorporated herein by reference. The preferred rhodium dopant is diammonium aquapentachlororhodate. Mixtures of dopants can be used also.

The other silver halide emulsion layers ("second" and "fourth" emulsion layers) can be doped also with the same or different dopants.

A general summary of silver halide emulsions and their preparation is provided by *Research Disclosure,* Item 38957, cited above, Section I. Emulsion grains and their preparation. After precipitation and before chemical sensitization the emulsions can be washed by any convenient conventional technique using techniques disclosed by *Research Disclosure,* Item 38957, cited above, Section III. Emulsion washing.

The emulsions can be chemically sensitized by any convenient conventional technique as illustrated by *Research Disclosure,* Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindenes, and others described in U.S. Pat. No. 5,800,976 (Dickerson et al) that is incorporated herein by reference for the teaching of the sulfur-containing covering power enhancing compounds. Such compounds are generally present at concentrations of at least 20 mg/silver mole, and preferably of at least 30 mg/silver mole. The concentration can generally be as much as 2000 mg/silver mole and preferably as much as 700 mg/silver mole.

It may again be desirable that one or more silver halide emulsion layers on each side of the film support include dextran or polyacrylamide as water-soluble polymers that can also enhance covering power. These polymers are generally present in an amount of at least 0.1:1 weight ratio to the gelatino-vehicle (described below), and preferably in an amount of from about 0.3:1 to about 0.5:1 weight ratio to the gelatino-vehicle.

Moreover, the ratio of photographic speed of each bottom silver halide to each top silver halide emulsion layer in the radiographic film independently must be at least 0.3 log E, and preferably at least 0.4 log E. This ratio can be the same or different for each side of the film.

Obtaining the desired photographic speed in the noted silver halide emulsion layers is not a difficult thing for someone skilled in the art. For example, speed can be achieved and adjusted in a given silver halide emulsion by emulsion by increasing emulsion grain size or improving the spectrochemical sensitization.

The silver halide emulsion layers and other hydrophilic layers on both sides of the support of the radiographic film generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure,* Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al), incorporated herein by reference.

The silver halide emulsion layers (and other hydrophilic layers) in the radiographic films of this invention are generally fully hardened using one or more conventional hardeners. Thus, the amount of hardener in each silver halide emulsion and other hydrophilic layer is generally at least 0.4% and preferably at least 0.6%, based on the total dry weight of the polymer vehicle in each layer.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydi-hydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (e.g., mucochloric and mucobromic acids), onium-substituted acroleins, vinyl sulfones containing other hardening functional groups, polymeric hardeners such as dialdehyde starches, and copoly(acrolein-methacrylic acid).

On each side of the radiographic film support, the level of silver is generally at least 15 and no more than 20 mg/dm$^2$, and preferably at least 17 and no more than 18 mg/dm$^2$. In addition, the total coverage of polymer vehicle is generally at least 26 and no more than 35 mg/dm$^2$, and preferably at least 28 and no more than 32 mg/dm$^2$. The amounts of silver and polymer vehicle on the two sides of the support can be the same or different. These amounts refer to dry weights.

The radiographic films generally include a surface protective overcoat on each side of the support that is typically provided for physical protection of the emulsion layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure,* Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers. The overcoat on at least one side of the support can also include a blue toning dye or a tetraazaindene (such as 4-hydroxy-6-methyl-1,3,3a,7-tetraazaindene) if desired.

The protective overcoat is generally comprised of a hydrophilic colloid vehicle, chosen from among the same types disclosed above in connection with the emulsion layers. In conventional radiographic films protective overcoats are provided to perform two basic functions. They provide a layer between the emulsion layers and the surface of the element for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

The various coated layers of radiographic films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

Another essential feature of the radiographic films of this invention is the presence of one or more microcrystalline particulate dyes in the first and third silver halide emulsion layers (that is, the bottom emulsion layers). The presence of such dyes reduces crossover during film use in radiographic assemblies to less than 15%, preferably 10% or less and more preferably 5% or less. The amount in the film to achieve this result will vary on the particular dye(s) used, as well as other factors, but generally the amount of particulate dye is at least 0.5 mg/dm$^2$, and preferably at least 1 mg/dm$^2$, and up to and including 2 mg/dm$^2$.

The particulate dyes generally provide optical densities of at least 1.0, and preferably at least 1. Examples of useful particulate dyes and teaching of their synthesis are described in U.S. Pat. No. 5,021,327 (noted above, Cols. 11–50) and U.S. Pat. No. 5,576,156 (noted above, Cols. 6–7), both incorporated herein by reference for description of the dyes. Preferred particulate dyes are nonionic polymethine dyes that include the merocyanine, oxonol, hemioxonol, styryl and arylidene dyes. These dyes are nonionic in the pH range of coating, but ionic under the alkaline pH of wet processing. A particularly useful dye is 1-(4'-carboxyphenyl)-4-(4'-dimethylaminobenzylidene)-3-ethoxycarbonyl-2-pyrazolin-5-one (identified as Dye XOC-1 herein).

The dye can be added directly to the hydrophilic colloid as a particulate solid or it can be converted to a particulate solid after it has been added to the hydrophilic colloid, as described in U.S. Pat. No. 5,021,327 (Col. 49).

In addition to being present in particulate form and satisfying the optical density requirements described above, the dyes useful in the practice of this invention must be substantially decolorized during wet processing. The term "substantially decolorized" is used to mean that the density contributed to the image after processing is no more than 0.1, and preferably no more than 0.05, within the visible spectrum.

Preferred embodiments of the present invention comprise a dual coated radiographic film comprising a light transmissive support and having disposed on each side thereof the same following layers:

a first tabular grain silver bromide (at least 98 mol % bromide) emulsion layer comprising from about 1 to about 2 mg/dm$^2$ of a particulate microcrystalline dye that reduces crossover to 10% or less and a rhodium dopant in an amount of from about $1\times10^{-5}$ to about $5\times10^{-5}$ mol/mol Ag in the first emulsion layer, a second silver halide grain top emulsion layer comprising a tabular silver bromide (at least 98 mol % bromide) grain emulsion, the amount of silver on each side of the support being from about 17 to about 18 mg/dm$^2$, the ratio of photographic speed of the first silver halide emulsion layer to the photographic speed of the second silver halide emulsion layer being at least 0.3 log E, a hydrophilic interlayer, and a hydrophilic overcoat.

The radiographic imaging assemblies of the present invention are composed of a radiographic film as described herein and intensifying screens adjacent the front and back of the radiographic film. The screens are typically designed to absorb X-rays and to emit electromagnetic radiation having a wavelength greater than 300 nm. These screens can take any convenient form providing they meet all of the usual requirements for use in radiographic imaging, as described for example in U.S. Pat. No. 5,021,327 (noted above), incorporated herein by reference. A variety of such screens are commercially available from several sources including by not limited to, LANEX™, X-SIGHT™ and InSight™ Skeletal screens available from Eastman Kodak Company. The front and back screens can be appropriately chosen depending upon the type of emissions desired, the photicity desired, whether the films are symmetrical or asymmetrical, film emulsion speeds, and % crossover.

Exposure and processing of the radiographic films of this invention can be undertaken in any convenient conventional manner. The exposure and processing techniques of U.S. Pat. Nos. 5,021,327 and 5,576,156 (both noted above), are typical for processing radiographic films. Other processing compositions (both developing and fixing compositions) are described in U.S. Pat. No. 5,738,979 (Fitterman et al), U.S. Pat. No. 5,866,309 (Fitterman et al), U.S. Pat. No. 5,871,890 (Fitterman et al), U.S. Pat. No. 5,935,770 (Fitterman et al), U.S. Pat. No. 5,942,378 (Fitterman et al), all incorporated herein by reference. The processing compositions can be supplied as single- or multi-part formulations, and in concentrated form or as more diluted working strength solutions.

It is particularly desirable that the films of this invention be processed within 90 seconds, and preferably within 45 seconds and at least 20 seconds, including developing, fixing and any washing (or rinsing). Such processing can be carried out in any suitable processing equipment including but not limited to, a Kodak X-OMAT™ RA 480 processor that can utilize Kodak Rapid Access processing chemistry. Other "rapid access processors" are described for example in U.S.

Pat. No. 3,545,971 (Barnes et al) and EP-A-0 248,390 (Akio et al). Preferably, the black-and-white developing compositions used during processing are free of any gelatin hardeners, such as glutaraldehyde.

Since rapid access processors employed in the industry vary in their specific processing cycles and selections of processing compositions, the preferred radiographic films satisfying the requirements of the present invention are specifically identified as those that are capable of dry-to-dye processing according to the following reference conditions:

| | |
|---|---|
| Development | 11.1 seconds at 35° C., |
| Fixing | 9.4 seconds at 35° C., |
| Washing | 7.6 seconds at 35° C., |
| Drying | 12.2 seconds at 55–65° C. |

Any additional time is taken up in transport between processing steps. Typical black-and-white developing and fixing compositions are described in the Example below.

Radiographic kits of the present invention can include one or more samples of radiographic film of this invention, one or more intensifying screens used in the radiographic imaging assemblies, and/or one or more suitable processing compositions (for example black-and-white developing and fixing compositions). Preferably, the kit includes all of these components. Alternatively, the radiographic kit can include a radiographic imaging assembly as described herein and one or more of the noted processing compositions.

The following example is provided for illustrative purposes, and is not meant to be limiting in any way.

EXAMPLE

Radiographic Film A (Control):

Radiographic Film A is commercially available KODAK InSight™ ITC Film that is often used for thoracic radiographic examinations. It was a dual coated having silver halide emulsions on both sides of a blue-tinted 178 μm transparent poly(ethylene terephthalate) film support. Each silver halide emulsion layer contained a green-sensitized mixture of two different high aspect ratio tabular silver bromide emulsions (wherein "high aspect ratio" is defined by U.S. Pat. No. 4,425,425, noted above) having at least 50 mol % of the total grain projected area being accounted for by tabular grains having a thickness of less than 0.3 μm and an average aspect ratio greater than 8:1. The emulsions were chemically sensitized with sodium thiosulfate, potassium tetrachloroaurate, sodium thiocyanate and potassium selenocyanate, and spectrally sensitized with 400 or 680 mg/Ag mole of anhydro-5,5-dichloro-9-ethyl-3,3'-bis(3-sulfopropyl)oxacarbocyanine hydroxide, followed by 300 mg/Ag mole of potassium iodide.

Radiographic Film A had the following layer arrangement:

Overcoat

Interlayer

High Contrast Emulsion Layer

Crossover Control Layer

Film Support

Crossover Control Layer

Low Contrast Emulsion Layer

Overcoat

The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| AgI Lippmann emulsion (0.08 μm) | 0.11 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| High Contrast Emulsion Layer Formulation | |
| T-grain emulsion (AgBr 2.0 × 0.10 μm) | 19.4 |
| Gelatin vehicle | 21.5 |
| 4-hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethylether | 1% based on total gelatin in all layers on that side |
| Crossover Control Layer | |
| Magenta microcrystalline dye XOC-1 | 0.25 |
| Gelatin | 6.7 |
| Low Contrast Emulsion Layer | |
| T-grain emulsion (AgBr 3.6 × 0.13 μm) | 7.8 |
| T-grain emulsion (AgBr 1.2 × 0.13 μm) | 10.1 |
| Gelatin vehicle | 21.5 |
| 4-hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethylether | 2.4% based on total gelatin on that side |

Radiographic Film B (Invention):

Radiographic Film B is within the present invention and had the following layer arrangement and formulations on both sides of the film support and was prepared similarly to Control Film A:

Overcoat

Interlayer

Upper Emulsion Layer

Lower Emulsion Layer and Crossover Control

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| AgI Lippmann emulsion (0.08 $\mu$m) | 0.11 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Upper Emulsion Layer Formulation | |
| T-grain emulsion (AgBr 3.6 × 0.13 $\mu$m) | 3.3 |
| Gelatin vehicle | 5.9 |
| 4-hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.14 |
| Bottom Emulsion Formulation | |
| T-grain emulsion (AgBr 2.6 × 0.10 $\mu$m) | 15 |
| Diammonium aquapentachlororhodate dopant | 3.89 × $10^{-5}$ mol/Ag mole |
| Gelatin | 17.7 |
| Magenta microcrystalline dye XOC-1 | 1.1 |
| 4-hydroxy-6-methyl-1,3,3a,7-tetraazaindene | 2.1 g/Ag mole |
| Potassium nitrate | 1.1 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethylether | 2.4% based on total gelatin in all layers on that side |

Intensifying Screens:

Radiographic Films A and B were exposed using commercially available KODAK InSight™ HC Screen.

Imaging assemblies were prepared by putting the appropriate intensifying screens on either side of Radiographic Films A and B. Each imaging assembly was exposed to 70 KVp X-radiation, varying either current (milliAmperes) or time, using a 3-phase Picker Medical (Model VTX-650) X-ray unit containing filtration up to 3 mm of aluminum. Sensitometric gradations in exposure were achieved by using a 21-increment (0.1 log E) aluminum step wedge of varying thickness.

Processing of the exposed film samples for sensitometric evaluation was carried out using a processor commercially available under the trademark KODAK RP X-OMAT film Processor M6A-N. Development was carried out using the following black-and-white developing composition:

| | |
|---|---|
| Hydroquinone | 30 g |
| Phenidone | 1.5 g |

-continued

| | |
|---|---|
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were in contact with the developer in each instance for less than 90 seconds. Fixing was carried out using KODAK RP X-OMAT LO Fixer and Replenisher fixing composition (Eastman Kodak Company).

Rapid processing has evolved over the last several years as a way to increase productivity in busy hospitals without compromising image quality or sensitometric response. Where 90-second processing times were once the standard, below 40-second processing is becoming the standard in medical radiography. One such example of a rapid processing system is the commercially available KODAK Rapid Access (RA) processing system that includes a line of X-ray sensitive films available as T-MAT-RA radiographic films that feature fully forehardened emulsions in order to maximize film diffusion rates and minimize film drying. Processing chemistry for this process is also available. As a result of the film being fully forehardened, glutaraldehyde (a common hardening agent) can be removed from the developer solution, resulting in ecological and safety advantages (see KODAK KWIK Developer below). The developer and fixer designed for this system are Kodak X-OMAT RA/30 chemicals. A commercially available processor that allows for the rapid access capability is the Kodak X-OMAT RA 480 processor. This processor is capable of running in 4 different processing cycles. "Extended" cycle is for 160 seconds, and is used for mammography where longer than normal processing results in higher speed and contrast. "Standard" cycle is 82 seconds, "Rapid Cycle" is 55 seconds and "KWJK/RA" cycle is 40 seconds (see KODAK KWIK Developer below). A proposed new "Super KWIK" cycle is intended to be 30 seconds (see KODAK Super KWIK Developer below). The two KWIK cycles (30 & 40 seconds) use the RA/30 chemistries while the longer time cycles use standard RP X-OMAT chemistry. The following Table I shows typical processing times (seconds) for these various processing cycles.

TABLE I

| Cycle | Extended | Standard | Rapid | KWIK | Super KWIK |
|---|---|---|---|---|---|
| Developer | 44.9 | 27.6 | 15.1 | 11.1 | 8.3 |
| Fixer | 37.5 | 18.3 | 12.9 | 9.4 | 7.0 |
| Wash | 30.1 | 15.5 | 10.4 | 7.6 | 5.6 |
| Drying | 47.5 | 21.0 | 16.6 | 12.2 | 9.1 |
| Total | 160.0 | 82.4 | 55 | 40.3 | 30.0 |

The black-and-white developer useful for the KODAK KWIK cycle contained the following components:

| | |
|---|---|
| Hydroquinone | 32 g |
| 4-Hydroxymethyl-4-methyl-1-phenyl-3-pyrazolidone | 6 g |
| Potassium bromide | 2.25 g |
| 5-Methylbenzotriazole | 0.125 g |
| Sodium sulfite | 160 g |
| Water to 1 liter, pH 10.35 | |

The black-and-white developer used for the KODAK Super KWIK cycle contained the following components:

| | |
|---|---|
| Hydroquinone | 30 g |
| 4-Hydroxymethyl-4-methyl-1-phenyl-3-pyrazolidone | 3 g |
| Phenylmercaptotetrazole | 0.02 g |
| 5-Nitroindazole | 0.02 g |
| Glutaraldehyde | 4.42 g |
| Diethylene glycol | 15 g |
| Sodium bicarbonate | 7.5 g |
| VERSENEX 80 | 2.8 g |
| Potassium sulfite | 71.48 g |
| Sodium sulfite | 11.75 g |
| Water to 1 liter, pH 10.6 | |

The "% Drying" was determined by feeding an exposed film flashed to result in a density of 1.0 into an X-ray processing machine. As the film just exits the drier section, the processing machine was stopped and the film was removed. Roller marks from the processing machine can be seen on the film where the film has not yet dried. Marks from 100% of the rollers in the drier indicate the film has just barely dried. Values less than 100% indicate the film has dried partway into the drier. The lower the value the better the film is for drying.

"Crossover" measurements were obtained by determining the density of the silver developed in each of the silver halide emulsion layers, in the silver halide emulsion layer adjacent the intensifying screen, and in the non-adjacent silver halide emulsion layer separated from the film support. By plotting the density produced by each silver halide emulsion layer versus the steps of a conventional step wedge (a measure of exposure), a characteristic sensitometric curve was generated for each silver halide emulsion layer. A higher density was produced for a given exposure of the silver halide emulsion layer adjacent the film support. Thus, the two sensitometric curves were offset in speed. At three different density levels in the relatively straight-line portions of the sensitometric curves between the toe and shoulder regions of the curves, the difference in speed ($\Delta$ log E) between the two sensitometric curves was measured. These differences were then averaged and used in the following equation to calculate the % crossover:

$$\%\ \text{Crossover} = \frac{1}{\text{antilog}(\Delta \log E) + 1} \times 100$$

The sensitometric results are shown in TABLE II below, and processing results are shown in TABLE III below. TABLE II shows that equivalent gamma (contrast) was achieved using the two films at exposure levels out to 0.5 log E. At higher exposure levels, however, such as would be required for thoracic imaging, Film B of the invention provided higher gamma values as well as a higher maximum gamma. It was surprising that this result could be achieved since Film B has significantly less silver than Film A before exposure and processing.

TABLE II

| Film | Speed | Contrast | $\text{Gamma}_{max}$ | Gamma @ 0.25 logE | Gamma @ 0.5 logE | Gamma @ 1.0 logE | Gamma @ 1.5 logE |
|---|---|---|---|---|---|---|---|
| Control A | 0 | 2.1 | 3.4 | 0.45 | 0.8 | 2.15 | 3.2 |
| Invention B | +0.05 | 2.3 | 3.7 | 0.45 | 0.8 | 2.5 | 3.4 |

TABLE III

| FILM | DYE STAIN | KWIK Drying Cycle |
|---|---|---|
| A | 0.25 | >100% |
| B | 0.14 | 50% |

The data in TABLE III show that the invention Film B dried at considerably less of dryer capacity (50%) than did Film A. Thus, Control Film A did not dry during the very short process cycle (required more than 100% of dryer capacity). Because invention Film B had less silver initially, it exhibited less dye stain than did Control Film A after imaging and processing.

The invention has been described in detail with particular reference to preferred embodiments thereof, but it will be understood that variations and modifications can be effected within the spirit and scope of the invention.

I claim:

1. A high contrast radiographic silver halide film comprising a support having first and second major surfaces and that is capable of transmitting X-radiation, said film having disposed on said first major support surface, two or more hydrophilic colloid layers including first and second silver halide emulsion layers, and on said second major support surface, two or more hydrophilic colloid layers including third and fourth silver halide emulsion layers, said first and third silver halide emulsion layers being closer to the support than said second and fourth silver halide emulsion layers, respectively, each of said first, second, third and fourth silver halide emulsion layers comprising silver halide tabular grains that (a) have the same or different composition in each silver halide emulsion layer, (b) account for at least 50% of the total grain projected area within each silver halide emulsion layer, (c) have an average thickness of less than 0.3 $\mu$m, and (d) have an average aspect ratio of greater than 5, the silver coverage on each side of said support being from about 15 to about 20 mg/dm$^2$, all hydrophilic layers of the film being fully forehardened and wet processing solution permeable for image formation within 45 seconds, said first and third silver halide emulsion layers comprising at least one particulate dye that is (a) capable of absorbing radiation to which said silver halide emulsions are sensitive, (b) present in an amount sufficient to reduce crossover to less than 15%, and (c) capable of being substantially decolorized during wet processing, said first and third silver halide emulsion layers also comprising a rhodium dopant for said tabular silver halide grains, said rhodium dopant being present in each silver halide emulsion layer in an amount, independently, of from about $1\times10^{-5}$ to about $5\times10^{-5}$ mole per mole of silver in each emulsion layer, and the ratio of photographic speed of said first silver halide emulsion layer to said second silver halide emulsion layer and the ratio of said third silver halide emulsion layer to said fourth silver halide emulsion layer being independently greater than 0.3 log E.

2. The film of claim 1 wherein said particulate dye is present in an amount sufficient to reduce crossover to 10% or less.

3. The film of claim 1 wherein said tabular silver halide grains of each silver halide emulsion is composed of at least 80% bromide based on total silver in that emulsion.

4. The film of claim 3 wherein tabular silver halide grains of each silver halide emulsion is composed of at least 98% bromide based on total silver in that emulsion.

5. The film of claim 1 wherein said tabular silver halide grains have an ECD of from about 1.6 to about 2.4, and an average thickness of from about 0.12 to about 0.18 $\mu$m.

6. The film of claim 1 wherein at least 90% of the silver halide grain projected area in each silver halide emulsion layer is provided by tabular silver halide grains having an aspect ratio greater than 10.

7. The film of claim 1 wherein said particulate dye is present in an amount of from about 0.5 to about 2 mg/dm$^2$.

8. The film of claim 1 further comprising an overcoat over said silver halide emulsions on each side of said film support.

9. The film of claim 1 wherein said rhodium is present in each of said first and third silver halide emulsion layers in an amount, independently, of from about $2\times10^{-5}$ to about $4\times10^{-5}$ mol/mol Ag in each of those emulsion layers.

10. The film of claim 9 wherein said rhodium dopant is present in the same amount in each of said first and third silver halide emulsion layers.

11. The film of claim 1 wherein said rhodium dopant is a rhodium halide, rhodium cyanate, rhodium thiocyanate, rhodium selenocyanate, rhodium tellurocyanate, rhodium azide, or a mixture of any two or more of these.

12. The film of claim 1 wherein said rhodium dopant is diammonium aquapentachlororhodate.

13. The film of claim 1 wherein the ratio of photographic speed of said first silver halide emulsion layer to said second silver halide emulsion layer and the ratio of said third silver halide emulsion layer to said fourth silver halide emulsion layer being independently greater than 0.4 log E.

14. The film of claim 1 comprising a polymer vehicle on each side of said support in a total amount of from about 26 to about 35 mg/dm$^2$.

15. The film of claim 14 wherein the total polymer vehicle on each side is from about 28 to about 32 mg/dm$^2$, and the level of silver on each side is from about 17 to about 18 mg/dm$^2$.

16. A radiographic imaging assembly comprising the radiographic film of claim 1 provided in combination with an intensifying screen on either side of the film.

17. A method comprising contacting the radiographic film of claim 1, sequentially, with a black-and-white developing composition and a fixing composition, said method being carried out within 90 seconds to provide a black-and-white image.

18. The method of claim 17 wherein said black-and-white developing composition is free of any photographic film hardeners.

19. The method of claim 17 being carried out for 45 seconds or less.

20. The method of claim 19 being carried out for from about 20 to about 45 seconds.

21. A radiographic kit comprising the radiographic film of claim 1 and one or more of the following:

a) an intensifying screen, b) a black-and-white developing composition, and c) a fixing composition.

22. A radiographic kit comprising the radiographic imaging assembly of claim 16 and one or more of the following:

a) a black-and-white developing composition, and b) a fixing composition.

* * * * *